US009309742B2

(12) United States Patent
Marya et al.

(10) Patent No.: US 9,309,742 B2
(45) Date of Patent: Apr. 12, 2016

(54) SYSTEM AND METHOD UTILIZING FRANGIBLE COMPONENTS

(75) Inventors: Manuel P. Marya, Sugar Land, TX (US); Timothy R. Dunne, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 461 days.

(21) Appl. No.: 13/494,548

(22) Filed: Jun. 12, 2012

(65) Prior Publication Data

US 2013/0327545 A1 Dec. 12, 2013

(51) Int. Cl.
*E21B 33/129* (2006.01)

(52) U.S. Cl.
CPC ..... *E21B 33/129* (2013.01)

(58) Field of Classification Search
CPC ..... E21B 23/00; E21B 19/10; E21B 33/129
USPC ..... 166/376, 377, 382, 387, 215, 77.53
See application file for complete search history.

(56) References Cited

U.S. PATENT DOCUMENTS 5,379,835 A * 1/1995 Streich ..... 166/181
5,709,269 A 1/1998 Head
6,224,112 B1 5/2001 Eriksen et al.
2008/0202764 A1 8/2008 Clayton et al.
2008/0264627 A1 10/2008 Roberts et al.
2010/0132960 A1* 6/2010 Shkurti et al. ..... 166/387
2011/0048743 A1 3/2011 Stafford et al.

OTHER PUBLICATIONS

International Search Report and Written Opinion mailed on Aug. 22, 2013 for International Patent Application No. PCT/US2013/043497, filed on May 31, 2013, 14 pages.

* cited by examiner

*Primary Examiner* — Yong-Suk (Philip) Ro
(74) *Attorney, Agent, or Firm* — Jeffrey R. Peterson

(57) ABSTRACT

A technique facilitates use of frangible components. The frangible components may comprise components of a gripping tool, e.g. anchor, used in a variety of applications, including well related applications. The tool is provided with a plurality of gripping members which each comprise a frangible structure. The gripping members may be selectively deployed to provide the desired gripping within a tubular structure, e.g. an open wellbore or well casing. The frangible structure in each gripping member is designed to break down into smaller portions after being exposed to a predetermined input, thus facilitating removal of the tool from the tubular structure.

19 Claims, 6 Drawing Sheets

SYSTEM AND METHOD UTILIZING FRANGIBLE COMPONENTS

BACKGROUND

Noon Hydrocarbon fluids such as oil and natural gas are obtained from a subterranean geologic formation, referred to as reservoir, by drilling a well that penetrates the hydrocarbon-bearing formation. In completing the well, a wide range of downhole equipment may be utilized. In some applications, an anchor is deployed against the rock formation or against product tubing to facilitate downhole operations. The anchor may comprise equipment designed to frictionally interact with the surface of the surrounding formation or tubing. Once the downhole operation is completed, the anchor is removed in a relatively costly and time-consuming procedure which can potentially subject the formation to damage.

SUMMARY

In general, the present disclosure provides a system and method for utilizing frangible components with a variety of tools. For example, the system and method may be used in providing gripping, e.g. anchoring, capability in a variety of applications, including well-related applications. In this example, a tool is provided with a plurality of gripping members which each comprise a frangible structure. The gripping members may be selectively deployed to provide the desired gripping within a tubular structure, e.g. an open wellbore or well casing. The frangible structure in each gripping member is designed to end up in smaller portions, i.e. break down into smaller portions, after being exposed to a predetermined input, thus facilitating removal of the tool from the tubular structure.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
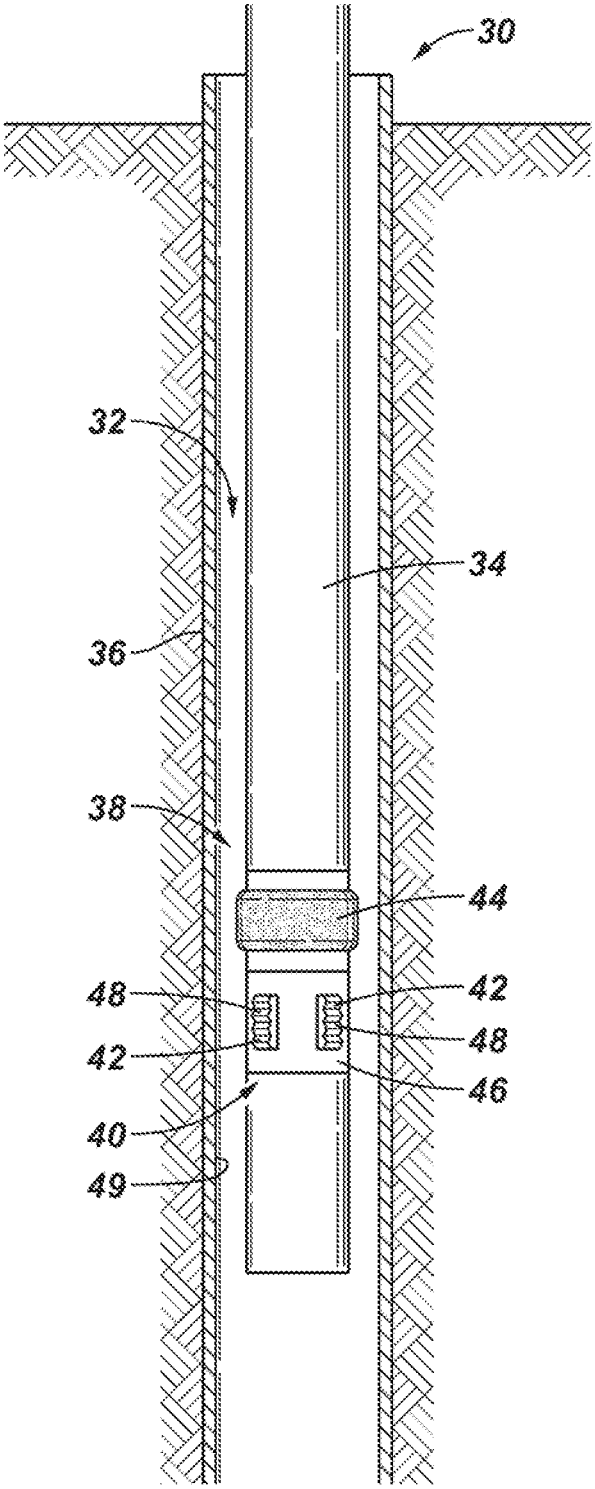
FIG. 1 is an illustration of an example of a well system deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to enabling removal of components of a tool when a specific operational use of the tool is completed. For example, the system and methodology may be used to enable selective breakdown of tool components into smaller portions to facilitate removal of the tool from a wellbore or other tubular structure. In some well applications, gripping members may be designed with frangible structures that break down into smaller portions following a predetermined input to initiate destruction of the frangible structures. This approach contrasts with a conventional approach of designing permanent components able to withstand a wellbore environment over long periods of time.

In a specific example, the tool is a downhole tool and comprises an anchor having a plurality of actuatable gripping members. The gripping members may be in the form of anchor slips having a base portion and a wall gripping portion. The base portion and/or the wall gripping portion may be formed with a frangible structure which breaks down into smaller portions following a predetermined input in the wellbore. By way of example, the frangible structure may comprise a degradable material, e.g. dissolvable material, or a material/structure which is subject to controlled fracture. Whether degraded or fractured, the frangible structure undergoes a controlled breakdown of the gripping member following operation of the tool, thus facilitating removal of the tool. In some applications, the wall gripping portion is formed from a harder material than the base portion. By way of example, the wall gripping portion may be formed as a hard coating, insert, surface treatment, or other type of structure combined with the softer base portion.

The frangible structure may be designed to degrade, dissolve, fracture, or otherwise break down into smaller pieces upon the occurrence of various predetermined inputs. By way of example, the input may be exposure to the well environment over a predetermined time period. The input also may comprise other naturally occurring wellbore characteristics, such as increased temperature, increased pressure, chemical composition of downhole fluids, or other influences that occur in many wellbore environments. The input also may be introduced into the wellbore environment. For example, breakdown of the frangible structure may be initiated by changes in temperature introduced into the wellbore, electrical inputs introduced into the wellbore, chemicals introduced into the wellbore, and/or other inputs directed to the well tool to initiate breakdown of the desired tool components, e.g. gripping members.

Referring generally to FIG. 1, an example of a well system is illustrated as comprising a tubing string deployed in a well. The well system can be used in a variety of well applications, including onshore applications and offshore applications. In this example, the tubing string is illustrated as deployed in a generally vertical wellbore, however the tubing string may be deployed in a variety of wells including various vertical and deviated wells. The embodiments described below may be employed to facilitate, for example, production and/or servicing operations in well applications and in other types of tubing strings. It should be noted, however, the frangible components may be used in other types of tubular structures and in other types of applications, including non-well applications.

In the example illustrated in FIG. 1, a well system 30 is deployed in a wellbore 32 and comprises a tubing string 34. The tubing string 34 may be deployed in an open hole wellbore or a cased wellbore lined with a casing 36, and the wellbore 32 may comprise a generally vertical or deviated wellbore. Depending on the application, the tubing string 34 may comprise a variety of components including a completion 38 or other well equipment. By way of example, the well equipment may comprise a tool 40 having frangible components 42 which may be selectively deconstructed into smaller pieces to facilitate a desired operation, such as removal of the tool 40 from wellbore 32. The completion or other well equipment 38 also may comprise a variety of other components, such as a packer 44, valves, subs, sensors systems, tubular structures, and/or other components assembled in tubing string 34 for a specific application.

Depending on the specific type of well application, tool 40 may be constructed in the form of an anchor 46 and frangible components 42 may comprise gripping members 48, e.g. anchor slips. In this type of application, the gripping members 48 may be designed for engaging a wall 49 in a subterranean wellbore, e.g. engaging the surrounding formation wall or an internal surface of a surrounding casing. The gripping members 48 are constructed, at least in part, with frangible material which undergoes a predetermined breakdown upon appropriate input. Thus, anchor 46 may be selectively actuated downhole to cause radially outward movement of the gripping members 48 for engagement with the surrounding wellbore wall. Upon completion of the desired operation, the frangible gripping members 48 can be selectively deconstructed, i.e. broken down, into smaller pieces through degradation, material fracture, and/or other suitable techniques.

In some applications, the frangible components 42 are formed as composite components of two different materials. As described in greater detail below, the frangible components 42 may be formed with portions of relatively softer and harder material. If, for example, the frangible components 42 are gripping members 48 formed as anchor slips, the anchor slips may comprise a base portion of relatively softer material and a wall gripping portion of relatively harder material to facilitate gripping engagement with a surrounding wall. Either or both of the base portion and the wall gripping portion comprises a frangible structure which degrades (e.g. dissolves/disintegrates), fractures, or otherwise breaks down the frangible component 42 into smaller pieces upon the occurrence of a predetermined input. In this example, the predetermined input may comprise a naturally occurring environmental factor, such as temperature, pressure, and/or chemical composition occurring in a wellbore. However, the predetermined input also may include externally initiated inputs, such as delivery of electrical inputs, magnetic inputs, thermal inputs, specific force loading inputs, and/or other externally initiated inputs.

Figure 2:
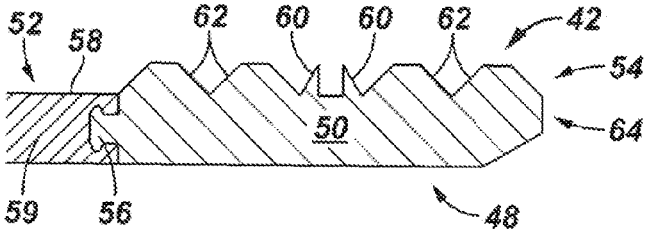
FIG. 2 is a cross-sectional view of an example of a gripping member, according to an embodiment of the disclosure.
Figure 3:
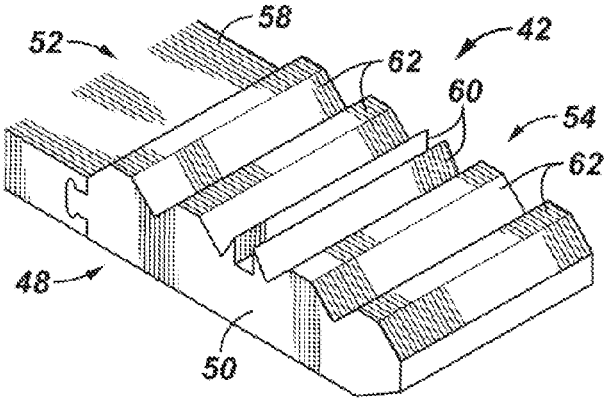
FIG. 3 is an orthogonal view of the gripping member illustrated in FIG. 2, according to an embodiment of the disclosure.

Referring generally to FIGS. 2 and 3, an example, of frangible component 42 is illustrated. In this specific example, the frangible component 42 comprises gripping member 48 which may be constructed in the form of an anchor slip 50. As illustrated, the anchor slip 50 comprises a base portion 52 and a wall gripping portion 54 designed to grip a surrounding wall, such as a surrounding formation wall or casing wall. The base portion 52 and the gripping portion 54 may be coupled together by a locking feature 56, such as a slide-in engaging member in which the locking feature 56 includes a profile of gripping portion 54 slidably received in a corresponding profile of base portion 52.

In this example, the entire base portion 52 is formed as a frangible structure 58 by virtue of being formed of a degradable material 59, e.g. a dissolvable material. The frangible structure 58 may be designed to break down over time when exposed to the heat and/or chemical composition of a downhole environment. Depending on the specifics of a given application, a variety of degradable materials may be employed to dissolve or otherwise degrade and such materials are available from Schlumberger Corporation and other suppliers. In this example, the gripping portion 54 is formed from a harder material, such as a ceramic material, a carbide-based material, a nitride material, and/or a variety of other materials suitable for engaging the surrounding wellbore wall. Depending on the design of gripping portion 54 and base portion 52, the hard material may be formed as an insert which is brazed, adhered, integrally cast, press fit, threadably engaged, slidably engaged, or otherwise attached to the softer material of the base portion 52. However, the hard material of gripping portion 54 also may be formed via a surface treatment, a coating, a casting treatment, or another suitable technique for combining the hard material with the corresponding softer material.

The gripping portion 54 also may utilize many types of gripping features, such as a sharp teeth 60 for penetrating and engaging the formation or tubing and wide teeth 62 for evenly distributing pressure and creating a larger frictional interaction with the formation or tubing. In some applications, the base portion 52 may include a radially inward region 64 of the illustrated gripping portion 54, such that the hard material of the gripping portion 54 is distributed along its radially outward region for engagement with the surrounding wall via teeth 60, 62. Although the base portion 52 has been described as degradable, the gripping portion 54 also may be constructed as a frangible portion such that the entire gripping member 48 may be broken down into smaller pieces in a controlled manner.

Figure 4:
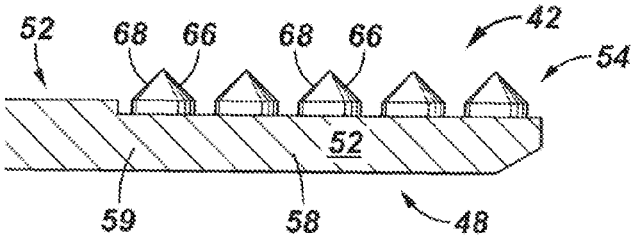
FIG. 4 is a cross-sectional view of another example of a gripping member, according to an embodiment of the disclosure.
Figure 5:
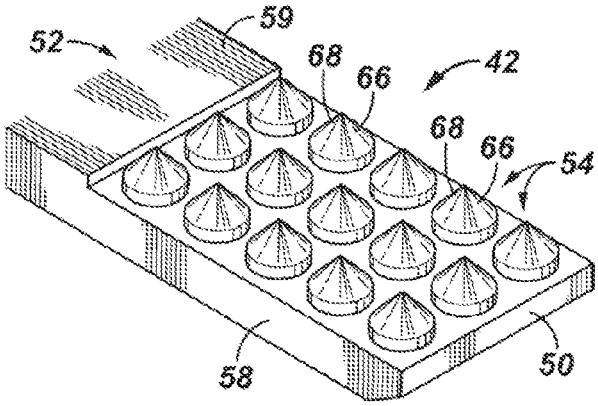
FIG. 5 is an orthogonal view of the gripping member illustrated in FIG. 4, according to an embodiment of the disclosure.
Figure 6:
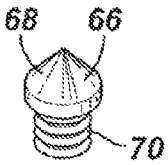
FIG. 6 is a view of an example of a hard material insert that may be used in the gripping member, according to an embodiment of the disclosure.

Referring generally to FIGS. 4-6, another embodiment of the gripping member 48 is illustrated in the form of anchor slip 50. In this example, the base portion 52 is again constructed as a frangible component made with frangible structure 58 having material dissolvable in a wellbore environment. The gripping portion 54 is in the form of a plurality of inserts 66 which are received and held by the base portion 52. The inserts 66 are formed of a harder material than the base portion 52 and may comprise gripping features 68, such as points or sharp edges designed to grip a surrounding wall. The inserts 66 also may be arranged in a variety of patterns, e.g. adjacent rows of inserts as illustrated best in FIG. 5. Additionally, the inserts 66 may be securely engaged with base portion 52 via a variety of fastening mechanisms, such as a threaded engagement region 70 on each insert 66, as best illustrated in FIG. 6. The threaded engagement region 70 enables easy attachment of individual inserts 66 to base portion 52.

Again, the base portion 52 may be constructed in the form of frangible structure 58 by virtue of the use of degradable materials employed to dissolve or otherwise degrade in the wellbore environment. When the frangible structure 58, e.g. the degradable material 59 of base portion 52, dissolves or otherwise degrades the harder inserts 66 simply fall downhole as small pieces of debris. In this example, the harder material of gripping portion 54/inserts 66 may comprise tool steel or a ceramic material, (e.g. carbide, nitride, zirconia, and other suitable materials). The hard material inserts 66 also may comprise ceramic or diamond particles sintered together with a low-corrosion resistance material, e.g. iron base, so that over time the insert also is able to degrade and break down into smaller pieces.

Figure 7:
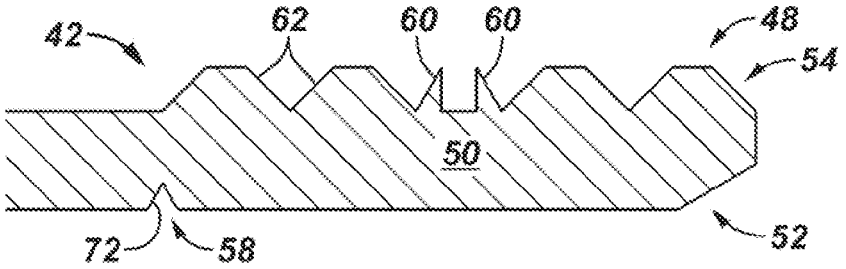
FIG. 7 is a cross-sectional view of another example of a gripping member, according to an embodiment of the disclosure.
Figure 8:
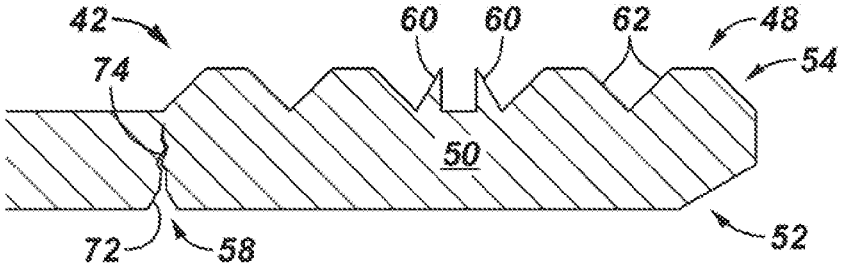
FIG. 8 is an illustration similar to that of FIG. 7 but showing the gripping member fracturing, according to an embodiment of the disclosure.

Referring generally to FIGS. 7-8, another embodiment of the gripping member 48 is illustrated in the form of anchor slip 50. In this example, the base portion 52 is again constructed as a frangible component made with frangible structure 58. Frangible structure 58 comprises at least one notch 72 in this embodiment. By way of example, the notch 72 may be located along a radially inward region of the base portion 52 as illustrated. However, individual notches or a plurality of notches 72, e.g. an array of notches, may be located along base portion 52 and/or wall gripping portion 54. The notch(es) 72 provides frangible structure 58 with a mechanism for enhanced breakdown of the gripping member 48 into smaller pieces that may be left in the well.

The notches 72 are designed to create local stress concentrations upon a predetermined loading of the gripping member 48. For example, when a predetermined load is oriented and applied to the gripping member 48 beyond a predetermined fracture value, a crack 74 is formed, as illustrated best in FIG. 8. The predetermined load may be applied according to a variety of techniques, including increased hydraulic actuation force applied against the slips 50 or application of tensile or compressive loading through tubing string 34. Application of the predetermined loading causes crack 74 to propagate through the material of base portion 52 and/or wall gripping portion 54, thus causing fracturing and break down of the gripping member 48 into smaller pieces. Depending on a variety of design parameters, the base portion 52 may be constructed from degradable materials and/or harder materials amenable to the controlled creation of cracks 74.

Figure 9:
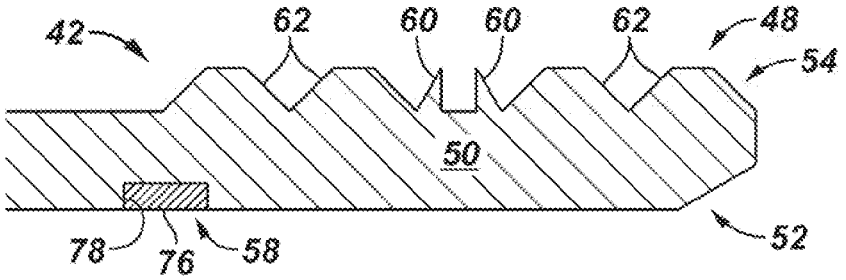
FIG. 9 is a cross-sectional view of another example of a gripping member, according to an embodiment of the disclosure.
Figure 10:
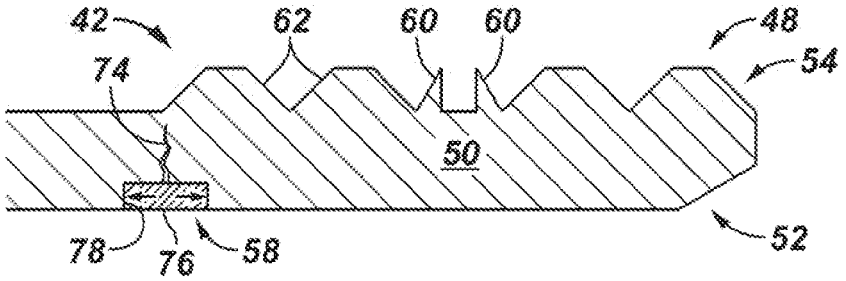
FIG. 10 is an illustration similar to that of FIG. 6 but showing the gripping member fracturing, according to an embodiment of the disclosure.

The fracture loading also may be applied by an embedded material, as illustrated in the embodiment of FIGS. 9 and 10. In this embodiment, the frangible structure 58 is created with a smart material 76 embedded in individual or plural regions of the gripping member 48. The smart material 76 is designed to respond to a predetermined input so as to load the gripping member 48 in a manner which creates formation of cracks 74, as best illustrated in FIG. 10. By way of example, the smart material 76 may comprise a shape memory material responsive to changes in temperature. Temperature change, e.g. temperature increase, may be used to cause expansion of the material 76 (see FIG. 10) and the resultant creation of local stress concentrations that induce formation of cracks 74. In some applications, notches 78 are pre-machined in the material of gripping member 48 and sized to receive the corresponding smart material 76.

The smart material 76, e.g. shape memory material, may be located at multiple positions along gripping member 48 (or other frangible component 42) to induce fracture at desired locations. The design and placement of the smart material 76 may be selected to induce cracking through tension and/or compression based on expansion or contraction of the material when a desired input, e.g. temperature change, is applied. Again, the base portion 52 may be constructed from degradable materials or harder materials amenable to the controlled creation of cracks 74. In some applications, the entire frangible component 42, e.g. gripping member 48, may be constructed from the same type of material.

Figure 11:
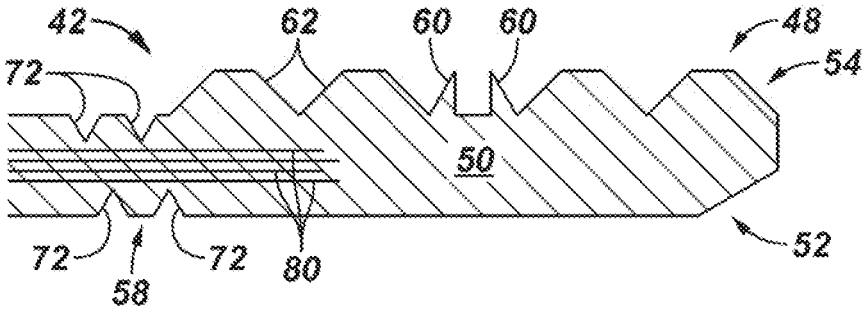
FIG. 11 is a cross-sectional view of another example of a gripping member, according to an embodiment of the disclosure.
Figure 12:
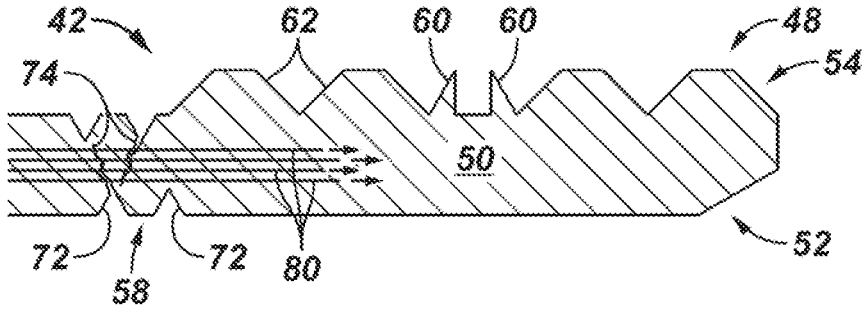
FIG. 12 is an illustration similar to that of FIG. 11 but showing the gripping member fracturing, according to an embodiment of the disclosure.

Referring generally to FIGS. 11-12, another example of frangible structure 58 is illustrated. In this embodiment, the frangible structure 58 is constructed with a plurality of fibers 80 located in base portion 52 and/or in other regions of the frangible component 42, e.g. gripping member 48. The plurality of fibers 80 responds to predetermined inputs to expand or contract and to thus induce formation of cracks 74, as best illustrated in FIG. 12. By way of example, the fibers 80 may comprise thermal fibers formed of a material which substantially expands and contracts when exposed to changes in temperature. Thus, temperature change may be used as an input to induce controlled fracturing of the frangible component 42 after completion of a well operation. In some applications, the fibers 80 may be combined with a plurality of notches 72 to further facilitate the controlled breakdown of the component, e.g. slip 50, into smaller portions.

For example, if the fibers 80 are thermally responsive fibers a large temperature change can be used to expand the fibers, as illustrated in FIG. 12. The expansion of fibers 80 creates stress concentrations in, for example, notches 72. Consequently, cracks 74 are formed and propagate through the material, thus causing failure of the frangible component 42. After the fibers fail, the component breaks into multiple smaller portions which can be retained within the well or removed. By changing the number and locations of the fibers 80, the formation of cracks 74 is readily controlled. In other embodiments, fibers with low coefficients of expansion, e.g. Kevlar fibers, are contracted relative to the surrounding material in downhole conditions. Such an approach enables creation of tensile stresses at the notches 72 so as to cause fracturing of the component.

Figure 13:
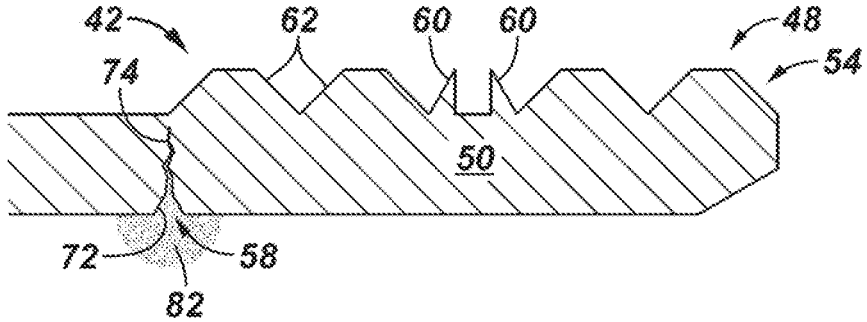
FIG. 13 is a cross-sectional view similar to that of FIG. 7 but showing introduction of a chemical to initiate fracturing, according to an embodiment of the disclosure.

In FIG. 13, another example of the frangible structure 58 is illustrated as comprising notches 72. In this embodiment, controlled cracks 74 are initiated and propagated by combining notches 72 with a chemical 82. The chemical 82 may be introduced to the region or naturally occurring in the region of frangible component 42 and is designed to attack the material proximate notch 72. By way of example, the entire gripping member 48 may be formed from a hard material that is susceptible to chemical attack by chemical 82. Notches 72 provide regions where the chemical 82 is able to react with the most effect with respect to introducing failure. Volatile downhole compounds or controlled chemicals may be used to attack the material, e.g. metal, used to form gripping members 48. The chemical attack ultimately results in over stressing of the region at each notch 72, thus initiating crack formation and propagation of cracks 74 through the gripping member material. In this manner, the frangible structure 58 again facilitates the controlled breakdown of material into smaller portions following the predetermined input, e.g. addition of chemicals and/or exposure to the wellbore environment over a predetermined time period.

Figure 14:
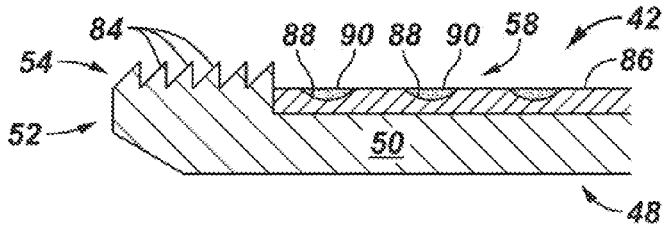
FIG. 14 is a cross-sectional view of another example of a gripping member, according to an embodiment of the disclosure.
Figure 15:
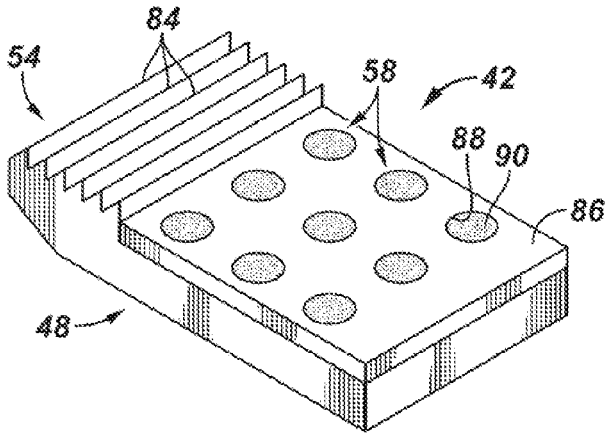
FIG. 15 is an orthogonal view of the gripping member illustrated in FIG. 14, according to an embodiment of the disclosure.

Referring generally to FIGS. 14-15, another embodiment of frangible component 42 is illustrated. By way of example, the frangible component 42 may comprise gripping member 48 in the form of, for example, anchor slip 50. In this example, the wall gripping portion 54 comprises a plurality of sharp teeth 84 oriented to grip a surrounding wall when moved in a radially outward direction into engagement with the surrounding wall. The gripping member 48 also comprises frangible structure 58 in the form of an anodic layer of material 86 having a plurality of holes 88 filled with cathodic plugs 90. The plurality of holes 88 may be arranged in a desired array, as best illustrated in FIG. 15. Additionally, the anodic layer 86, cathodic plugs 90 and teeth 84 may be mounted on a base portion 52 or in other suitable arrangements.

Liquid media, e.g. well fluid, enables an electrochemical reaction to occur between the cathodic and anodic materials. The electrochemical reaction ultimately creates weak points between cathodic plugs 90, and the material between cathodic plugs 90 becomes overstressed. Consequently, cracks form in the overstressed regions and the integrity of the gripping member 48 is compromised until the component breaks into smaller sized portions. Effectively, natural selection of cathodic/anodic materials may be used to obtain a desired behavior. In some embodiments, the smaller sized portions simply drop downhole and remain at a downhole collection region.

Figure 16:
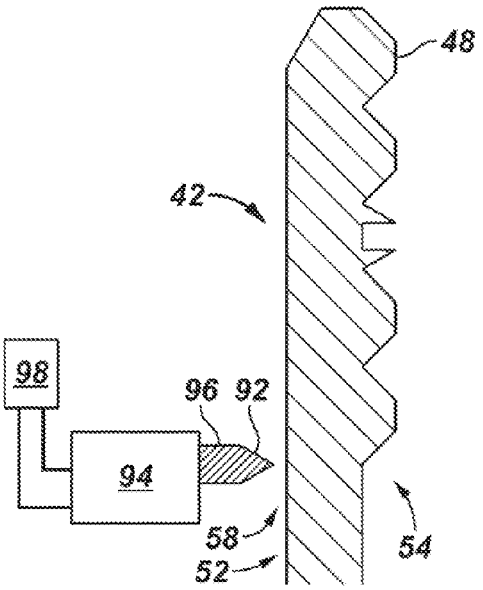
FIG. 16 is an illustration of a gripping member cooperating with a fracture inducing element, according to an embodiment of the disclosure.
Figure 17:
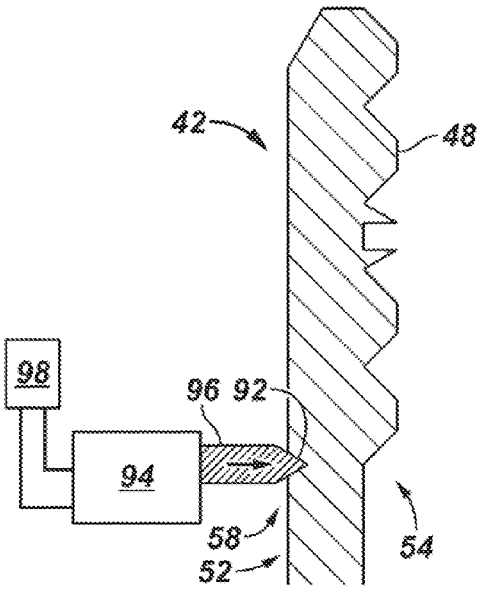
FIG. 17 is an illustration similar to that of FIG. 16 but showing the gripping member at a different stage of fracture, according to an embodiment of the disclosure.
Figure 18:
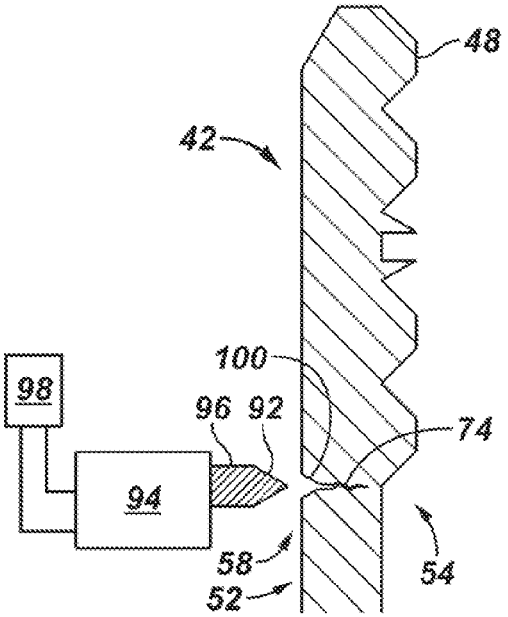
FIG. 18 is an illustration similar to that of FIG. 16 but showing the gripping member at a different stage of fracture, according to an embodiment of the disclosure.

As illustrated in FIGS. 16-18, breakdown of the frangible component 42 into smaller portions also may be initiated mechanically. As illustrated in FIG. 16, a fracture tool 92, e.g. a knife, may be controlled by an actuator 94, e.g. a piezo electric actuator, designed to move the tool 92 into the frangible component 42 at frangible structure 58. In the example illustrated, the hard knife 92 is controlled by actuator 94 via an extension member 96. A power supply 98 provides electrical power to the piezo electric actuator 94 causing expansion of piezo electric material and extension of member 96 to drive knife 92 into the frangible component 42, as best illustrated in FIG. 17. The actuator 94 may be repeatedly actuated to cause repeated engagement and retraction of knife 92 with respect to frangible structure 58 of component 42 until a notch 100 is created, as illustrated in FIG. 18. Creation of notch 100 further causes creation of cracks 74 and ultimately causes the breakdown of frangible component 42, e.g. anchor slip 50, into smaller portions to facilitate removal of tool 40.

Figure 19:
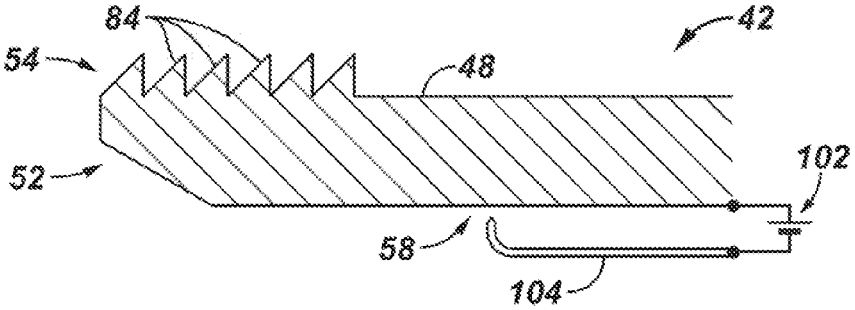
FIG. 19 is a cross-sectional view of another example of a gripping member, according to an embodiment of the disclosure.
Figure 20:
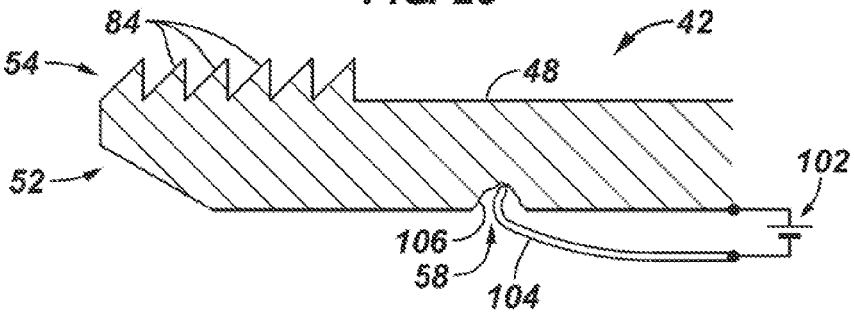
FIG. 20 is an illustration similar to that of FIG. 19 but showing the gripping member fracturing, according to an embodiment of the disclosure.

Referring generally to FIGS. 19 and 20, another embodiment of frangible component 42, e.g. gripping member 48, is illustrated. In this example, a battery 102 is combined with a conductive smart material wire 104 on the frangible component 42 to form an incomplete circuit. After a desired input, e.g. stimulus, is applied to the smart material wire 104, the wire 104 deforms and contacts the structural material forming frangible structure 58 of the gripping member 48 or other type of frangible component 42. For example, the wire 104 may deform to contact base portion 52 of the gripping member 48 to complete an electrical circuit. Upon completion of the electrical circuit, preferential corrosion is created at a corrosion site 106 of frangible structure 58, as illustrated best in FIG. 20. Creation of individual or plural corrosion sites 106 creates weak points which allow the frangible component 42 to break into a plurality of smaller portions. In some applications, the smaller portions are simply left downhole.

The predetermined input used to initiate breakdown of the frangible component 42 may vary according to the parameters of a given application and the structural design of tool 40. For example, temperature changes, e.g. thermal shock, induced downhole or occurring naturally during operations in the downhole environment may be used in combination with thermal materials, e.g. shape memory materials and/or embedded thermal fibers, to create stresses which cause cracking of the frangible component into a plurality of smaller portions. In other applications, magnetism may be employed to produce sufficient shock to the frangible component to breakdown the component. In such applications, a material may be selected which is susceptible to magnetic change rather than, for example, temperature change. Upon introduction of a magnetic field, a magnetic response is induced in the magnetic material embedded in or otherwise combined with the frangible component 42. In combination with the magnetic material, the frangible component may utilize a variety of notches or other stress concentrators to facilitate initiation of failure when the material reacts in response to the induced magnetic field. By way of example, electrical charges may be used to induce the magnetic field in proximity to the gripping member 48 or other frangible component 42.

In some applications, the predetermined input may comprise chemical inputs. The chemical inputs may be provided by volatile organic compounds, acids, and/or other chemical constituents which exist in many downhole environments. In other applications, the chemical may be introduced downhole to react with a specific material of the frangible component 42 to cause degradation of the material at specific notches or other stress concentration locations. Concentrated degradation of the material to create fracture points also may be initiated by electrochemical reactions. For example, the frangible component 42 may comprise a variety of cathodic and anodic materials which, when combined with the downhole liquid media, create an electrochemical reaction which weakens specific regions of the frangible component. These weakened regions ultimately become overstressed and cause breakdown of the component into smaller portions. Additionally, supplemental devices, e.g. electromechanical/piezo electric devices may be constructed as micro electromechanical system (MEMS) devices designed to initiate fracture of the frangible component 42. Many types of MEMS devices can be combined with the frangible component to enable controlled initiation of the component breakdown. Additionally, the various inputs and crack initiator techniques may be used together in many types of combinations.

In many of the embodiments described above, at least a portion of the frangible component, e.g. gripping member 48, may be formed of degradable material which dissolves or otherwise degrades into very small portions/particles.

Depending on the parameters of a given application, the degradable material may be combined with a variety of harder materials to facilitate desired functionality, e.g. gripping of a surrounding casing wall. The harder material also may be designed to fracture into smaller portions upon introduction of a predetermined input. In some applications, however, the degradable material simply breaks down into smaller portions allowing the harder component to fall to a collection region in the wellbore.

Depending on the well application or other type of tubing string application, and on the desired function of the overall well system, various embodiments described herein may be used to facilitate a variety of production and/or servicing operations. Accordingly, the overall well system may comprise many types of components and arrangements of components. Additionally, the frangible components may be combined with a variety of tools in many types of configurations and combinations of materials. Similarly, many types of predetermined inputs may be used to initiate breakdown, e.g. fracturing, degradation, erosion, of the frangible components into a plurality of smaller portions, e.g. pieces or particles.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A device for use in a wellbore, comprising:

an anchoring tool comprising a plurality of slips, each slip having a base portion and a wall gripping portion, the base portion being formed with a frangible structure which breaks down into smaller portions following a predetermined input in the wellbore, wherein the base portion is formed of a first material and the gripping portion is formed of a second material, wherein further the frangible structure comprises at least one notch designed to fracture the base portion when placed under a predetermined load.

2. The device as recited in claim 1, wherein the frangible structure comprises a degradable material degradable in a wellbore environment.

3. The device as recited in claim 1, wherein the frangible structure comprises a material subject to cracking.

4. The device as recited in claim 1, wherein the frangible structure comprises an embedded smart material which fractures the base portion when the embedded smart material is subjected to the predetermined input.

5. The device as recited in claim 4, wherein the embedded smart material comprises a shape memory material which changes shape when subjected to changes in temperature.

6. The device as recited in claim 1, wherein the frangible structure comprises a plurality of fibers disposed in the base portion, the fibers changing length when subjected to the predetermined input.

7. The device as recited in claim 6, wherein the plurality of fibers comprises thermal fibers which undergo changes in length upon predetermined changes in temperature to fracture the base portion.

8. The device as recited in claim 1, wherein the wall gripping portion is formed of a harder material than the base portion.

9. The device as recited in claim 1, wherein the wall gripping portion also is formed of a frangible structure.

10. A system for use in a well, comprising:

a tubing string; and a tool mounted to the tubing string, the tool comprising gripping members oriented to grip a surrounding wall located in the well, the gripping members being formed with a frangible structure, the frangible structure breaking down into smaller portions upon a predetermined input, wherein each gripping member comprises a base portion and a gripping portion, the gripping portion being formed of a harder material than the base portion, wherein further the frangible structure comprises at least one notch designed to fracture the base portion when placed under a predetermined load.

11. The system as recited in claim 10, wherein the tool comprises an anchor and the gripping members comprise anchor slips.

12. The system as recited in claim 10, wherein the gripping portion comprises a plurality of teeth designed to grip a well casing.

13. The system as recited in claim 10, wherein the gripping portion comprises a plurality of removable inserts.

14. The system as recited in claim 10, wherein the frangible structure comprises a degradable material.

15. The system as recited in claim 10, wherein the frangible structure comprises an element which expands or contracts due to changes in temperature.

16. A method of providing temporary gripping capability in a wellbore, comprising:

providing a well tool with a plurality of gripping members each formed with a frangible structure;

creating at least one notch in the frangible structure designed to fracture the frangible structure when placed under a predetermined loading;

deploying the well tool in a well;

operating the plurality of gripping members to grip a surrounding wall; and exposing the frangible structure in each gripping member to an input causing breakdown of the frangible structure into smaller portions.

17. The method as recited in claim 16, further comprising providing each gripping member with the base portion and the gripping portion in which the gripping portion is harder than the base portion.

18. The method as recited in claim 16, wherein exposing comprises subjecting the frangible structure to a change in temperature.

19. The method as recited in claim 16, wherein exposing comprises subjecting the frangible structure to a predetermined loading to cause fracture.

* * * * *